US011551831B2

(12) United States Patent
Ni

(10) Patent No.: US 11,551,831 B2
(45) Date of Patent: Jan. 10, 2023

(54) DATA TRANSMISSION CABLE

(71) Applicant: ALLTOP ELECTRONICS (SUZHOU) LTD., Suzhou (CN)

(72) Inventor: Mindi Ni, Suzhou (CN)

(73) Assignee: ALLTOP ELECTRONICS (SUZHOU) LTD., Suzhou (CN)

( * ) Notice: Subject to any disclaimer, the term of this patent is extended or adjusted under 35 U.S.C. 154(b) by 0 days.

(21) Appl. No.: 17/469,848

(22) Filed: Sep. 8, 2021

(65) Prior Publication Data

US 2022/0076863 A1 Mar. 10, 2022

(30) Foreign Application Priority Data

Sep. 10, 2020 (CN) ..... 202021965278.X
Apr. 23, 2021 (CN) ..... 202120852185.4

(51) Int. Cl.
*H01B 7/08* (2006.01)
*H01B 11/18* (2006.01)

(52) U.S. Cl.
CPC ..... *H01B 11/1895* (2013.01); *H01B 7/0823* (2013.01); *H01B 11/1808* (2013.01)

(58) Field of Classification Search
CPC ..... H01B 7/08
See application file for complete search history.

(56) References Cited

U.S. PATENT DOCUMENTS 4,475,006 A * 10/1984 Olyphant, Jr. ..... H01B 7/0861 174/105 R
2011/0247877 A1* 10/2011 Onodi ..... H01R 4/2487 174/117 F

FOREIGN PATENT DOCUMENTS

JP 2010-244838 * 10/2010
JP 2018-181565 * 11/2018

* cited by examiner

*Primary Examiner* — Chau N Nguyen
(74) *Attorney, Agent, or Firm* — Cheng-Ju Chiang

(57) ABSTRACT

A data transmission cable includes a plurality of juxtaposed wires, a plastic layer enclosing on the wires integrally and a metallic shielding layer arranged on an outer side of the plastic layer. The metallic shielding layer has a length matching the data transmission cable and a width greater than the circumferential extension length of the data transmission cable, two ends of the metallic shielding layer in a width direction are compacted and bonded to each other on one side of the data transmission cable in the width direction, to form a shielding portion covering the plastic layer and a compacting portion connected to one side of the shielding portion.

9 Claims, 2 Drawing Sheets

DATA TRANSMISSION CABLE

CROSS REFERENCE TO RELATED APPLICATIONS

The present application claims the priority of Chinese Patent Application No. 202021965278.X filed on Sep. 10, 2020, and Chinese Patent Application No. 202120852185.4 filed on Apr. 23, 2021, the contents of which are hereby incorporated by reference into this application.

BACKGROUND

1. Technical Field

The present disclosure relates to a data transmission cable, and more particularly to a data transmission cable with stable signal transmission performance.

2. Description of Related Art

In the 3C industry, a transmission cable can be used as a medium for an electrical connection between two electronic devices and can carry out the expected signal transmission stably. Therefore, the transmission cable is widely used in various electronic devices. In particular, transmission cables connected with USB, HDMI, DVI, Displayport and other types of connector has a performance of higher transmission rate, longer transmission distance and higher quality, and is popular with consumers. The transmission cable usually has a plurality of metal wires inside thereof, the metal wires are generally fixed only by an outer mylar layer in a cylindrical shape, and with no shielding settings, thereby the signal transmission stability of the entire data transmission cable is poor.

It is desirable to provide an improved data transmission cable for solving above problems.

SUMMARY

In one aspect, the present invention includes a data transmission cable comprising a plurality of juxtaposed wires, a plastic layer enclosing on the wires integrally and a metallic shielding layer arranged on an outer side of the plastic layer. The metallic shielding layer has a length matching the data transmission cable and a width greater than the circumferential extension length of the data transmission cable, two ends of the metallic shielding layer in a width direction are compacted and bonded to each other on one side of the data transmission cable in the width direction, to form a shielding portion covering the plastic layer and a compacting portion connected to one side of the shielding portion.

The invention has the advantages that: The metallic shielding layer has the length matching the data transmission cable and the width greater than the circumferential extension length of the data transmission cable, two ends of the metallic shielding layer in the width direction are compacted and bonded to each other on one side of the data transmission cable in the width direction, thereby ensuring the shielding continuity of the metallic shielding layer and avoid any impedance discontinuity phenomenon, thus make the signal transmission can continue to be stable.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE ILLUSTRATED EMBODIMENT

Figure 1:
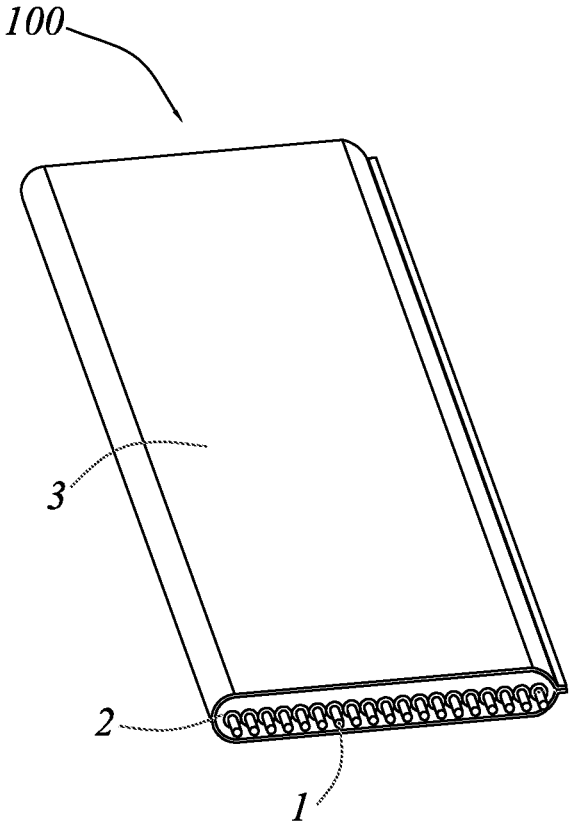
FIG. 1 is a perspective view of a data transmission cable in accordance with a preferred embodiment of the present disclosure.

Reference will now be made to the drawing figures to describe the embodiments of the present disclosure in detail. In the following description, the same drawing reference numerals are used for the same elements in different drawings.

Figure 2:
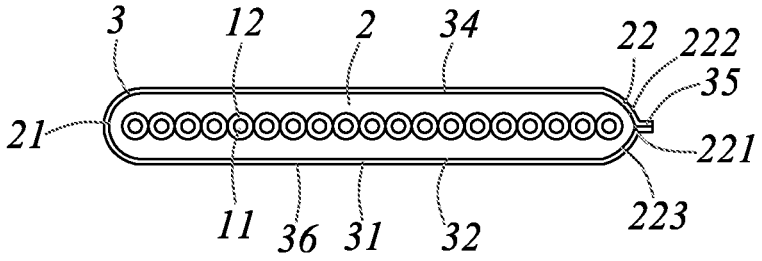
FIG. 2 is a front view of the data transmission cable shown in FIG. 1.

Referring to FIGS. 1 to 2, the present disclosure relates to a flat data transmission cable 100, and the data transmission cable 100 comprises a plurality of juxtaposed wires 1, a plastic layer 2 enclosing on the wires 1 integrally and a metallic shielding layer 3 arranged on an outer side of the plastic layer 2, a detailed illustration of several preferred embodiments is as follow.

In the present embodiment, each wire 1 has a conductor 11 and an insulative cladding layer 12 enclosing on the conductor 11. Central axes of the conductors 11 of the wires of the data transmission cable 100 are located on a same plane. Preferably, each conductor 11 has an outer diameter (traditionally expressed in AWG size) in the range of 31 to 34 American Wire Gauge (AWG).

The plastic layer 2 is enclosing on the cladding layers 12 to form a common single insulation layer. The plastic layer 2 defines a top surface and a bottom surface parallel to a plane in which central axes of the conductors 11 located. As the top surface of the plastic layer 2 parallel to the bottom surface, the arrangement of the conductors 11 can be effectively maintained for preventing distortion or folding. Furthermore, the wrapping arrangement of the metallic shielding layer 3 can be further facilitated for avoiding air interlayer between the plastic layer 2 and the metallic shielding layer 3.

The conductors 11 can be well protected by the cladding layer 12, thereby preventing short circuit caused by two adjacent conductors 11 contacting during the forming process of the plastic layer 2. Moreover, the thickness of the plastic layer 2 can also be set as light as possible when the wire 1 having the cladding layer 12, just making sure that the relative position of all wires 1, and then the thickness of the whole data transmission cable 100 can be reduced, thus the whole of data transmission cable 100 can be made much thinner and much softer.

The cladding layer 12 is made of same or similar material as the plastic layer 2, and preferably made of same kind material, thus when the data transmission cable 100 in the present invention is molded, the combination of the plastic layer 2 and the cladding layer 12 is better, and a good fusion can be achieved with minimizing the stratification problem or air entry, thus the forming effect is better.

Further, the same kind material is a polyhydrocarbon compound, and further, the polyhydrocarbon compound is preferably polyethylene.

In addition, the plastic layer 2 and the cladding layer 12 can be preferably made of plastic material with a dielectric coefficient close to air, therefore the impedance of the cladding layer 12 and the plastic layer 2 can be reduced, and a better signal transmission environment can be provided for the conductors 11, the propagation delay of signals and crosstalk between signals can be reduced to ensure high-speed and effective transmission of signals and reduce signal attenuation.

When the wire 1 having the cladding layer 12, in the thickness direction of the data transmission cable 100, the distance between the outer edge of the conductor 11 and the outer edge of the plastic layer 2 is in the range of 0.1 mm to 0.45 mm, and preferably in the range of 0.15 mm to 0.25 mm. The above distance is also the distance between the conductor 11 and metallic shielding layer 3, and one of the factors affecting the stable signal transmission of the wire 1, especially the high frequency data transmission. As the distance is smaller, the impedance is smaller and the high frequency performance is better. At the same time, the thickness of the whole data transmission cable 100 is smaller, and the data transmission cable 100 can be softer and thinner. However, if the thickness of the whole data transmission cable 100 is too small, the metallic shielding layer 3 will affect signal transmission of the conductors 11, and the above-mentioned interval of the invention can better meet various requirements.

Figure 3:
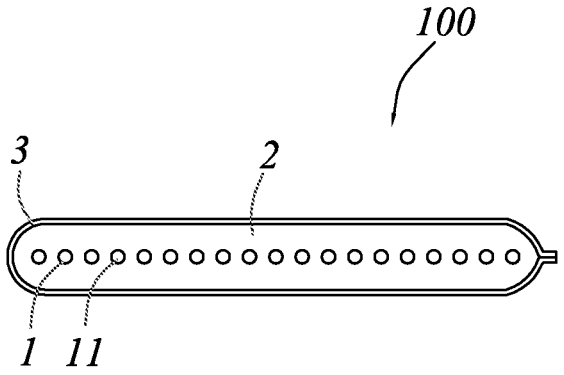
FIG. 3 is a front view of a data transmission cable in accordance with another preferred embodiment of the present disclosure.

Another embodiment of the present disclosure is disclosed in FIG. 3, each wire 1 also can have only the conductor 11 without the cladding layer 12, that is, the plastic layer 2 is directly enclosing on the wires 1, and the same effect can be achieved. By adopting the setting, the thickness of the plastic layer 2 can be further reduced, and the overall thickness of the data transmission cable 100 can be further reduced.

Referring to FIGS. 1 to 3, the wires 1 are disposed in an equally spaced arrangement in present embodiment, and in the arrangement direction of the wires 1, the number of the wires 1 is in the range of 3 to 50. Preferably, the data transmission cable 100 is provided with the center distance between every two neighboring wires 1 is equal to the outer diameter of the wire 1, that is to say, every two adjacent wires 1 are provided in close proximity to each other. This facilitates control of the overall forming of the data transmission cable 100.

The signal transmission settings of the wires 1 can be configured according to requirements, e.g., can comprise at least two grounding wires and at least a signal wire between the two grounding wires. Therefore, the interference around the signal wire can be eliminated by grounding wires, and the signal transmission environment of the signal wire can be guaranteed, thereby improving the efficiency and stability of signal transmission.

As a preferred embodiment of the present invention, in order to meet the development needs of high-speed signal transmission, the number of the signal wires between two adjacent ground wires is preferably two. And the two signal wires constitute a signal wire group for transmitting differential signals, that is to say, the grounding wire is used for protecting the signal wire group to ensure the high frequency transmission performance.

Additionally, the wires 1 only comprise a plurality of grounding wires and several signal wire groups, and the number of grounding wires is one more than that of the signal wire groups. Preferably, in the arrangement direction of the wires 1, the two wires 1 on both sides are grounding wires, and one signal wire group is arranged between every two neighboring grounding wires. Thus, each signal wire group can be protected by two neighboring grounding wires on both sides thereof, and the high frequency transmission characteristics of the whole data transmission cable 100 can be further improved.

In other embodiment of the present invention, in order to correspond with other single-ended signal transmission, the signal wires also define at least one single-ended signal wire. Such as the number of the signal wires is twice as that of the grounding wires, to accommodate Mini SAS (Mini Serial Attached Small Computer System Interface) standard, and in the arrangement direction of the wires 1, two single-ended signal wires are defined on outer sides of the grounding wires, that is to say, two single-ended signal wires are located on both sides of the entire data transmission cable 100, the grounding wires and the signal wire groups are arranged between the two single-ended signal wires in proper sequence.

Furthermore, in another embodiment of present invention, the data transmission cable 100 also can be provided with a plurality of grounding wires and a plurality of single-ended signal wires. Such as the number of the grounding wires is one more than that of the single-ended signal wires, to accommodate narrow version of Mini SAS standard. The specific arrangement is as follows: the two wires 1 on both sides are grounding wires to shield the whole data transmission cable 100 from both sides thereof, and in the arrangement direction of the wires 1, the grounding wires and the signal wires are arranged alternately.

In the present invention, all conductors 11 of the wires 1 have a same outer diameter, and the ratio of the center distance between every two neighboring wires 1 to the outer diameter of the conductor 11 is preferably in the range of 1.4 to 2.8. By this setting, when the wires 1 are provided with signal wire groups for differential signal transmission, the differential impedance of wires 1 in each signal wire group can be effectively reduced and controlled in the range of 75 to 110 Ohm, to enhance coupling effect and ensure long-distance transmission of high frequency signals.

In an optimized embodiment of present invention, the wires 1 define a plurality of signal wire groups for differential signal transmission, according to the setting of the plastic layer 2 and the metallic shielding layer 3, when the ratio of the center distance between two adjacent wires 1 in each signal wire group to the outer diameter of the conductor 11 is in the range of 1.4 to 2.8, the differential impedance of the wires 1 in each signal wire group is in the range of 79 to 106 Ohm.

Specifically, while the ratio of the center distance between two adjacent wires 1 in a same signal wire group to the outer diameter of the conductor 11 is in the range of 1.55 to 2.31, the differential impedance of the wires 1 in each signal wire group can be controlled in the range of 79 to 91 Ohm.

As a preferable embodiment of the present invention, in order to further ensure the softness and lightness of the data transmission cable 100, the conductor 11 has an outer diameter (traditionally expressed in AWG size) in the range of 31 to 33 American Wire Gauge (AWG), at this time, the center distance between two neighboring wires 1 in each signal wire group is defined in the range of 0.28 mm to 0.52 mm, to ensure the differential impedance of the wires 1 in each signal wire group in the range of 79 to 91 Ohm.

Among them, while the outer diameter of the conductor 11 is 31 AWG, the center distance between two neighboring wires 1 in each signal wire group is defined in the range of 0.44 mm to 0.52 mm, to guarantee the differential impedance of the wires 1 in each signal wire group in the range of 79 to 91 Ohm. Specifically, while the center distance between two neighboring wires 1 is 0.48 mm, the differential impedance of the wires 1 in each signal wire group can be controlled with 85 Ohm.

While the outer diameter of the conductor 11 is 32 AWG, the center distance between two neighboring wires 1 in each signal wire group is defined in the range of 0.36 mm to 0.44 mm, to guarantee the differential impedance of the wires 1 in each signal wire group in the range of 79 to 91 Ohm. Specifically, while the center distance between two neighboring wires 1 is 0.40 mm, the differential impedance of the wires 1 in each signal wire group can be controlled with 85 Ohm.

While the outer diameter of the conductor 11 is 33 AWG, the center distance between two neighboring wires 1 in each signal wire group is defined in the range of 0.28 mm to 0.36 mm, to guarantee the differential impedance of the wires 1 in each signal wire group in the range of 79 to 91 Ohm. Specifically, while the center distance between two neighboring wires 1 is 0.32 mm, the differential impedance of the wires 1 in each signal wire group can be controlled with 85 Ohm.

In addition, while the ratio of the center distance between two adjacent wires 1 in a same signal wire group to the outer diameter of the conductor 11 is in the range of 2.18 to 2.84, the differential impedance of the wires 1 in each signal wire group can be controlled in the range of 94 to 106 Ohm.

In an optimized embodiment of present invention, to ensure the softness and lightness of the data transmission cable 100, the outer diameter of the conductor 11 is 33 AWG or 34 AWG, the center distance between two neighboring wires 1 in each signal wire group is defined in the range of 0.35 mm to 0.51 mm, to guarantee the differential impedance of the wires 1 in each signal wire group in the range of 94 to 106 Ohm.

Among them, in present invention, while the outer diameter of the conductor 11 is 33 AWG, the center distance between two neighboring wires 1 in each signal wire group is defined in the range of 0.43 mm to 0.51 mm, to guarantee the differential impedance of the wires 1 in each signal wire group in the range of 94 to 106 Ohm. Specifically, while the center distance between two neighboring wires 1 is 0.48 mm, the differential impedance of the wires 1 in each signal wire group can be controlled with 100 Ohm.

While the outer diameter of the conductor 11 is 34 AWG, the center distance between two neighboring wires 1 in each signal wire group is defined in the range of 0.35 mm to 0.43 mm, to guarantee the differential impedance of the wires 1 in each signal wire group in the range of 94 to 106 Ohm. Specifically, while the center distance between two neighboring wires 1 is 0.40 mm, the differential impedance of the wires 1 in each signal wire group can be controlled with 100 Ohm.

Preferably, each wire 1 has the conductor 11 and the insulative cladding layer 12, and center distance between every two neighboring wires 1 is equal to the outer diameter of the wire 1, that is to say every two neighboring wires 1 are abutting each other, thus it's convenient for forming the data transmission cable 100.

Among them, conjunction with the aforementioned two embodiments, each wire 1 can or cannot have the cladding layer 12. After the wire 1 integrally covered by the plastic layer 2, the overall thickness of the wires 1 and the plastic layer 2 can be controlled in the range of 0.25 mm to 0.8 mm Combining with the conductor 11 has an outer diameter in the range of 31 to 34 AWG, the overall thickness of the wire 1 and the plastic layer 2 can be controlled in the range of 0.3 mm to 0.6 mm. Furthermore, for example, while the outer diameter of the conductor 11 is 32 AWG, the wire 1 defines the cladding layer 12 with a thickness of 0.1 mm, and the thickness of the plastic layer 2 is 0.07 mm, thus the overall thickness of the wire 1 and the plastic layer 2 can be controlled with 0.54 mm Certainly, the thickness of the cladding layer 12 and the plastic layer 2 can be adjusted according to actual needs and technical capabilities, and specific settings is not restricted to the conductor 11 with 32 AWG.

As previously described, the plastic layer 2 is integrally wrapped on the wires 1, and the metallic shielding layer 3 is wrapped on the plastic layer 2. In present invention, the metallic shielding layer 3 has a length matching the data transmission cable 100 and a width greater than the circumferential extension length of the data transmission cable 100. By this way, the metallic shielding layer 3 can be directly wrapping along a length and width direction to achieve a one-time complete wrapping, to ensure the shielding continuity of the metallic shielding layer 3 and avoid any impedance discontinuity phenomenon, thus make the signal transmission can continue to be stable. In addition, the metallic shielding layer 3 also has fire protection function, which can make the data transmission cable 100 reach horizontal flame retardant grade of FT-2 rating and vertical flame retardant grade of VW-1 rating.

Referring to FIGS. 1 to 3, as a preferred embodiment of the present invention, two ends of the metallic shielding layer 3 in the width direction are compacted and bonded to each other on one side of the data transmission cable 100 in the width direction, so that the metallic shielding layer 3 forms a shielding portion 34 covering the plastic layer 2 and a compacting portion 35 connected to one side of the shielding portion 34. The shielding portion 34 completely covers the plastic layer 2 in the circumferential direction to achieve all-round shielding, the compacting portion 35 is fixed on one side of the data transmission cable 100 and located at a middle position between the top surface and the bottom surface, which is convenient for fixing and bonding, and can also achieve tensioning and fixing of the metallic shielding layer 3 to further ensure the tightness of the fitting of the shielding portion 34 to the plastic layer 2.

In further, in present invention, the metallic shielding layer 3 has at least an aluminum foil layer 31 and a bonding layer 32 arranged on the side of the aluminum foil layer 31 facing to the plastic layer 2, thus the metallic shielding layer 3 is heat sealed and bonding to the outer side of the plastic layer 2 by the bonding layer 32. Thereby the fixing of the metallic shielding layer 3 is simpler and convenient, and without an intervention of a mylar layer fixing, the whole data transmission cable can be made thinner and more flexible. Moreover, air can be discharged during bonding, bonding strength and tightness between the metallic shielding layer 3 and the plastic layer 2 can be increased by means of heat sealing and bonding, and achieve integrally bonding without air entrapment. The effect of compaction can be achieved without the discharged air entering, thereby to achieve a tight wrapping, better high frequency transmission performance, soft and light effect.

Referring to FIGS. 1 to 3, the compacting portion 35 is the two ends of the metallic shielding layer 3 in the width direction, the metallic shielding layer 3 is folded in half and covered around the plastic layer 2, and is held in place on one side of the plastic layer 2 by the compacting portion 35, thus the compacting portion 35 is easy to fix and bond, the metallic shielding layer 3 can be tightened and fixed to further ensure the tightness of the bonding between the shielding portion 34 and the plastic layer 2. The width of the compacting portion 35 in the width direction of the data transmission cable 100 is in the range of 0.1 mm to 0.4 mm.

The minimum width is 0.1 mm, which can ensure that on the basis of being effectively fixed, the data transmission cable can avoid the phenomenon of edge cracking and shielding failure in the use process, and ensure the stability of signal transmission. The maximum width is set to 0.4 mm to ensure the user experience effect, that is, as far as possible without edge experience, and convenient in a limited space to ensure that multiple data transmission cables parallel will not interfere with each other.

Preferably, the width of the compacting portion 35 in the width direction of the data transmission cable 100 is defined in the range of 0.15 mm to 0.25 mm, to further improve the fixation and use experience of the compacting portion 35.

As aforementioned, the metallic shielding layer 3 in the invention is fixed on the outer side of the plastic layer 2 by heat sealing, during molding, heat sealing machine progressively presses the data transmission cable blank covered with the plastic layer 2 along the width direction thereof from one side of that width direction, so that the metallic shielding layer 3 is fixed to the outside of the plastic layer 2, the metallic shielding layer 3 is fixed relatively to each other on the other side of the plastic layer 2 in the width direction.

The plastic layer 2 has a left side surface 21 and a right side surface 22 located on the lateral sides thereof except the top surface and the bottom surface parallel to each other, the left side surface 21 and the right side surface 22 are arc-shaped and connected to both ends of the top surface and the bottom surface, however, after being fixed by heat sealing, both lateral sides of the plastic layer 2 are asymmetrical.

Specifically, two ends of the metallic shielding layer 3 in the width direction are compacted to each other on a right side of the plastic layer 2, the right side surface 22 is formed with a tip portion 221 at the plastic layer 2 corresponding to a fitting position of the metallic shielding layer 3. The right side surface 22 comprises a first surface 222 connecting the tip portion 221 with a right end of the top surface and a second surface 223 connecting the tip portion 221 with a right end of the bottom surface. The circular curvature of the first surface 222 and the second surface 223 is less than the circular curvature of the left side surface 21.

In addition, the metallic shielding layer 3 further has an insulating layer 36 arranged on the side of the aluminum foil layer 31 deviating from the plastic layer 2, the insulating layer 36 can replace the mylar layer in the prior art, insulate the outside and protect the aluminum foil layer 31 at the same time. Of course, the data transmission cable 100 in present invention can be further provided with a mylar layer outside the metallic shielding layer 3.

Furthermore, the whole thickness of the metallic shielding layer 3 is defined in the range of 0.010 mm to 0.055 mm, to minimize the thickness of the data transmission cable 100 on the basis of realizing external shielding. Preferably, the whole thickness of the metallic shielding layer 3 is defined in the range of 0.015 mm to 0.025 mm.

Combining with the setting of the conductor 11, the cladding layer 12, the plastic layer 2 and the thickness of the metallic shielding layer 3, the thickness of the data transmission cable 100 can be controlled in the range of 0.35 mm to 0.65 mm. For example, while the outer diameter of the conductor 11 is 32 AWG, the overall thickness of the wires 1 and the plastic layer 2 is about 0.54 mm, and the thickness of the metallic shielding layer 3 is 0.045 mm, thus the thickness of the data transmission cable 100 can be of 0.63 mm Certainly, the thickness of the cladding layer 12, the plastic layer 2 and the metallic shielding layer 3 can be adjusted according to actual needs and technical capabilities, and specific settings is not restricted to above embodiments.

In conclusion, the data transmission cable 100 in present invention is provided with a metallic shielding layer 3 covering on the outer side of the plastic layer 2, the metallic shielding layer 3 has the length matching the data transmission cable 100 and the width greater than the circumferential extension length of the data transmission cable 100, two ends of the metallic shielding layer 3 in the width direction are compacted and bonded to each other on one side of the data transmission cable 100 in the width direction, thereby ensuring the shielding continuity of the metallic shielding layer 3 and avoid any impedance discontinuity phenomenon, thus make the signal transmission can continue to be stable.

In addition, in the thickness direction of the data transmission cable 100, two parts of the metallic shielding layer 3 on the upper and lower sides of the plastic layer 2 are relatively compacted to each other on one lateral side of the plastic layer 2, thus forming the compacting portion 35. The width of the compacting portion 35 in the width direction of the data transmission cable 100 is in the range of 0.1 mm to 0.4 mm, therefore not only the data transmission cable 100 can be shielded from outside thereof to ensure the stability of signal transmission, but also the width of the compacting portion 35 is set to ensure that the edge width is minimized while the metallic shielding layer 3 can be effectively fixed, and avoid interference between multiple data transmission cables 100. In addition, the use of materials can be reduced and a problem of a wider edge resulting in poor use experience can be avoided.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. A data transmission cable, comprising:

a plurality of juxtaposed wires;

a plastic layer enclosing on the wires integrally; and a metallic shielding layer arranged on an outer side of the plastic layer;

wherein the metallic shielding layer has a length matching the data transmission cable and a width greater than the circumferential extension length of the data transmission cable, two ends of the metallic shielding layer in a width direction are compacted and bonded to each other on one side of the data transmission cable in the width direction, to form a shielding portion covering the plastic layer and a compacting portion connected to one side of the shielding portion;

wherein both lateral sides of the plastic layer are asymmetrical, the plastic layer defines a top surface and a bottom surface that extend in a transverse direction and are parallel to each other, a left side surface and a right side surface located on said lateral sides thereof, the left side surface and the right side surface are arc-shaped and connected to both ends of the top surface and the bottom surface; the compacting portion is located on a right side of the plastic layer, the right side surface is formed with a tip portion at the plastic layer corresponding to a fitting position of the metallic shielding layer; the right side surface comprises a first surface connecting the tip portion with a right end of the top surface and a second surface connecting the tip portion with a right end of the bottom surface, the circular curvature of the first surface and the second surface is less than the circular curvature of the left side surface.

2. The data transmission cable as claimed in claim 1, wherein said top surface and said bottom surface are parallel to a plane in which central axes of the wires are located, the compacting portion is located at a middle position between the top surface and the bottom surface.

3. The data transmission cable as claimed in claim 1, wherein a width of the compacting portion in the width direction of the data transmission cable is in the range of 0.1 mm to 0.4 mm.

4. The data transmission cable as claimed in claim 3, wherein the width of the compacting portion in the width direction of the data transmission cable is in the range of 0.15 mm to 0.25 mm.

5. The data transmission cable as claimed in claim 1, wherein the metallic shielding layer has at least an aluminum foil layer and a bonding layer arranged on the side of the aluminum foil layer facing to the plastic layer, the metallic shielding layer is heat sealed and bonding to the outer side of the plastic layer by the bonding layer, thereby the metallic shielding layer and the plastic layer are integrally bonding without air entrapment.

6. The data transmission cable as claimed in claim 5, wherein the metallic shielding layer further has an insulating layer arranged on the side of the aluminum foil layer deviating from the plastic layer.

7. The data transmission cable as claimed in claim 6, wherein the whole thickness of the metallic shielding layer is in the range of 0.010 mm to 0.055 mm.

8. The data transmission cable as claimed in claim 1, wherein the overall thickness of the wires and the plastic layer is in the range of 0.25 mm to 0.8 mm.

9. The data transmission cable as claimed in claim 1, wherein conductors of the wires have a same outer diameter, centers of the conductors are in a straight line, center distances between any two neighboring wires are equal, and each conductor has an outer diameter in the range of 31 to 34 AWG.

* * * * *